United States Patent [19]

Hunter

[11] Patent Number: 4,671,339

[45] Date of Patent: Jun. 9, 1987

[54] MOLD LOCKING DEVICE FOR AUTOMATIC MOLD MAKING MACHINE

[75] Inventor: William A. Hunter, Inverness, Ill.

[73] Assignee: Hunter Automated Machinery Corporation, Schaumburg, Ill.

[21] Appl. No.: 824,793

[22] Filed: Jan. 31, 1986

[51] Int. Cl.[4] ..... B22C 7/04; B22C 15/00

[52] U.S. Cl. ..... 164/182; 164/40; 164/183; 164/193; 164/194; 164/239; 164/214

[58] Field of Search ..... 164/182, 183, 193, 194, 164/214, 239, 240, 241, 242, 243, 40

[56] References Cited

U.S. PATENT DOCUMENTS 1,347,093 7/1920 Hanstine ..... 164/241
3,174,196 3/1965 Hansberg ..... 164/22 X
3,406,738 10/1968 Hunter ..... 164/182
3,417,811 12/1968 Masi ..... 164/240
3,512,756 5/1970 Cleland ..... 164/200 X

FOREIGN PATENT DOCUMENTS 2809608 9/1978 Fed. Rep. of Germany ..... 164/239

*Primary Examiner*—Nicholas P. Godici
*Assistant Examiner*—J. Reed Batten, Jr.
*Attorney, Agent, or Firm*—Leydig, Voit & Mayer

[57] ABSTRACT

Apertures are formed in the top surface of the platen assembly. A resilient diaphragm extends across each aperture and is extended upwardly through the aperture by a plunger. The extended diaphragm protrudes into sand within the flask and locks the sand mold against movement parallel to the top of the platen assembly.

8 Claims, 3 Drawing Figures

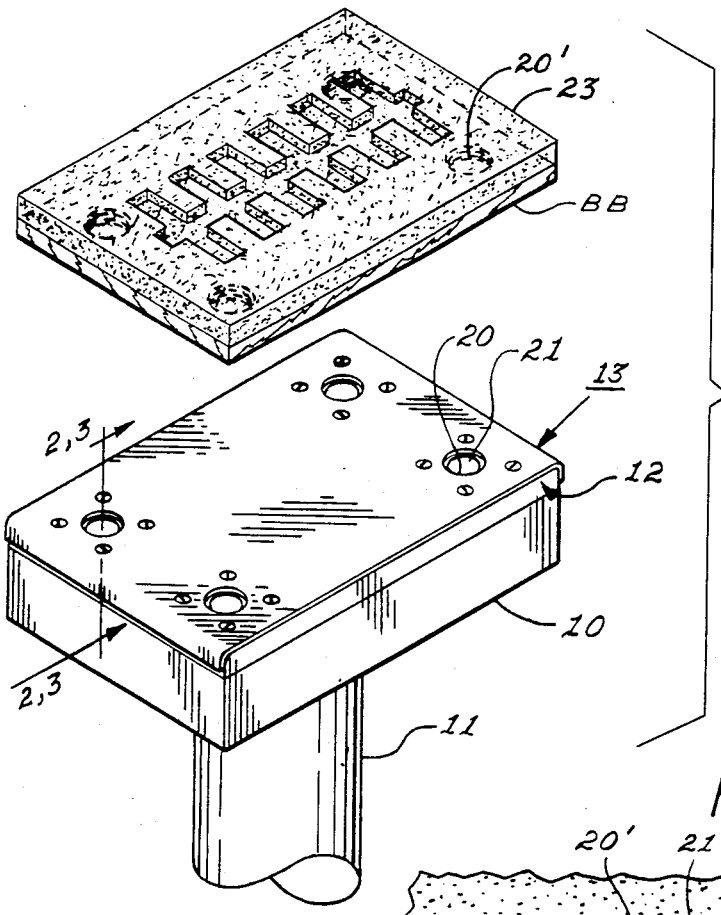
FIG. 1
FIG. 2
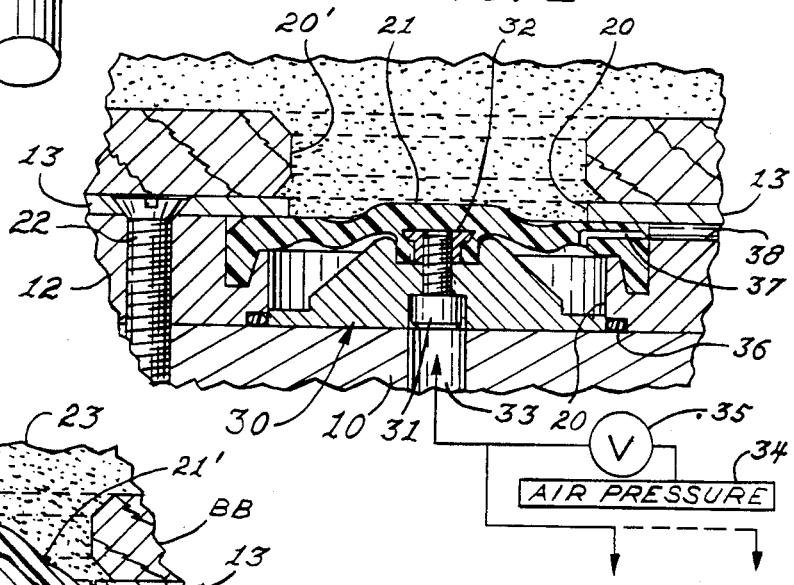
FIG. 3
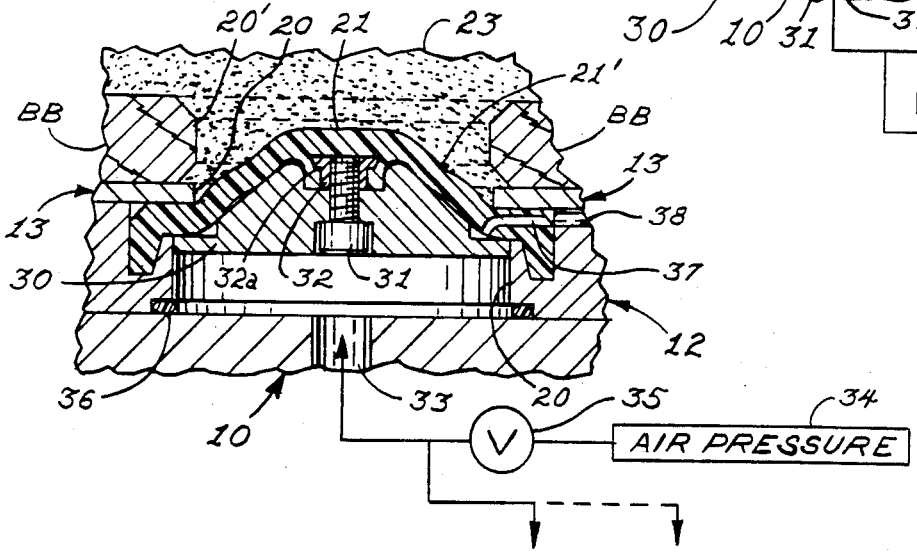

MOLD LOCKING DEVICE FOR AUTOMATIC MOLD MAKING MACHINE

FIELD OF THE INVENTION

The present invention relates generally to machines for making foundry molds from sand and, more particularly, to an improved mold locking device for such machines.

BACKGROUND OF THE INVENTION

In automatic mold making machines, such as the machine described in applicant's U.S. Pat. No. 3,406,738, the mold is formed by compacting a mixture of sand and a binder around a pattern within a mold flask. To compact the sand within the flask, the sand is compressed between a platen and a squeeze head with the pressure being applied by a hydraulic or pneumatic cylinder.

To hold the mold in place on the platen, locking pins have traditionally been used to restrain the mold against lateral movement on the platen. The locking pins are advanced upwardly into the sand prior to the high-pressure squeeze so that the pins protrude into the compacted sand and thereby lock the mold against lateral movement on the platen. When it is subsequently desired to remove the mold, the locking pins are retracted to permit the mold to slide freely over the platen.

These locking pins and their drive mechanisms add to the cost of automatic mold-making machines, and also present problems when sand filters down around the pins and into the drive mechanism. The sand can lead to abrasion problems, which in turn cause wear and maintenance problems throughout the operating life of the machine.

SUMMARY OF THE INVENTION

It is a primary object of the present invention to provide an automatic mold-making machine having an improved mold locking device which can be economically installed and which prevents the leakage of sand into the locking device.

It is another object of this invention to provide an automatic mold-making machine having an improved locking device which virtually eliminates wear and maintenance problems due to sand leakage into the locking mechanism, leading to a longer maintenance-free operating life.

Other objects and advantages of the invention will become apparent upon reading the following detailed description and upon reference to the accompanying drawings.

In accordance with the present invention, a machine for making sand molds for foundries and including a flask defining the side walls of a mold, a platen assembly at one open end of the flask and a squeeze head at the other open end of the flask for compacting sand in the flask when the platen assembly and squeeze head are advanced relatively toward each other, is improved by providing a plurality of apertures in the top surface of the platen assembly, a resilient diaphragm extending across each aperture, and means for extending each diaphragm upwardly through the aperture associated therewith so that the extended diaphragm protrudes into the sand within the flask and thereby locks the sand mold against movement parallel to the top of said platen assembly. In the preferred embodiment, the means for extending each diaphragm comprises a plunger mounted for movement between a retracted position in which the plunger allows the diaphragm to relax within the aperture associated therewith, and an advanced position in which the plunger presses the diaphragm upwardly through the associated aperture so that the diaphragm extends above the top surface of the platen assembly, and means for moving the plunger between said advanced and retracted positions.

BRIEF DESCRIPTION OF THE DRAWINGS

FIG. 1 is a perspective view of a platen assembly for use in an automatic mold-making machine and embodying the locking device of the present invention;

FIG. 2 is an enlarged section taken generally along the line 2–2 in FIG. 1, with the locking device in its retracted position; and FIG. 3 is the same section shown in FIG. 2 but with the locking device in its advanced position.

DESCRIPTION OF THE PREFERRED EMBODIMENT

While the invention is susceptible to various modifications and alternative forms, a specific embodiment thereof has been shown by way of example in the drawings and will be described in detail. It should be understood, however, that it is not intended to limit the invention to the particular form disclosed, but, on the contrary, the intention is to cover all modifications, equivalents, and alternatives falling within the scope of the invention as defined by the appended claims.

Turning now to the drawings and referring first to FIG. 1, there is shown a platen assembly for use in an automatic mold-making machine, such as the match-plate molding machine described in Hunter U.S. Pat. No. 3,406,738. This assembly includes a platen 10 mounted on the top of a ram 11 driven by a hydraulic or pneumatic cylinder (not shown). On top of the platen 10 is a lock plate 12 covered by a wear plate 13. As described in detail in the aforementioned U.S. Pat. No. 3,406,738, when the platen assembly is in use, the platen 10 and the wear plate 13 carry a bottom board BB supporting a volume of sand lightly compacted around one or more mold patterns within one or more flasks. As the platen assembly is moved upwardly by the ram 11, it raises the entire mold-forming assembly upwardly against a squeeze head and compacts the sand to a high density by squeezing the sand between the platen and the squeeze head at a relatively high pressure.

In accordance with the present invention, the lock plate 12 and the wear plate 13 have a plurality of apertures formed therein with a resilient diaphragm extending across each aperture and sealed to the lock plate and/or the wear plate around the entire periphery of the diaphragm, and means are provided within the platen assembly for extending each diaphragm upwardly through the apertures associated therewith so that the extended diaphragms project into the compacted sand and thereby lock the sand mold, formed on the top of the platen assembly, against movement parallel to the surface of the platen assembly. Thus, in the illustrative embodiment of the invention shown in FIGS. 2 and 3, apertures are formed in both the lock plate 12 and the wear plate 13 near the corners thereof. Within each of the apertures, a resilient flexible diaphragm 21 extends across the aperture, with the entire periphery of the diaphragm being captured between the lock plate 12 and the wear plate 13. More specifically, the peripheral portion of the diaphragm 21 extends radially outwardly into a recess formed by the lock plate 12 beneath the wear plate 13, and then downwardly into an annular groove formed by the lock plate.

When the diaphragm 21 is initially placed in the lock plate 12, prior to the application of the wear plate 13, the thickness of the peripheral portion of the diaphragm 21 is slightly greater than the height of the lateral recess formed by the lock plate 12 so that the diaphragm extends slightly above the top surface of the lock plate. Then when the wear plate 13 is placed on top of the lock plate 12 and fastened thereto by a plurality of cap screws 22, the diaphragm is compressed between the lock plate 12 and the wear plate 13 to form a tight seal which prevents the leakage of sand around the edges of the diaphragm 21. Thus, the region below the membrane 21 remains free of the abrasive sand.

FIGS. 2 and 3 both show a conventional bottom board BB positioned on the top of the wear plate 13. It can be seen that the bottom board is provided with apertures 20' which register with the apertures 20 in the wear plate 13 and the lock plate 12. In FIG. 2, the diaphragm 21 is in its relaxed or retracted position, and the sand 23 is only lightly compacted within the mold-forming cavity above the bottom board BB and in the apertures $20^1$.

Before the sand is squeezed to compact it to a high density, a plunger 30 attached to the underside of the diaphragm 21 is raised to extend the diaphragm 21 to the position shown in FIG. 3. In this extended position of the diaphragm 21, it extends upwardly through the aperture 20 formed by the wear plate 13 and protrudes into the sand within the aperture 20' of the bottom board BB. The diaphragm 21 is held in this extended position during the squeezing process, so that the sand is compacted tightly around the extended diaphragm, including the annular regions surrounding the sloping side flanks $21^1$ of the diaphragm. As long as the diaphragm 21 is in this extended position, the mold formed by the highly compacted sand is firmly restrained against lateral movement across the surface of the platen assembly.

As can be seen in FIGS. 2 and 3, the center of the plunger 30 is attached to the underside of the diaphragm 21 by means of a cap screw 31 threaded into a metal insert 32 which is held captive within the diaphragm 21 by means of a radial flange **32*a* at its upper end. The main body portion of the plunger 30 has a frusto conical shape to which the diaphragm 21 conforms when it is extended upwardly by the elevation of the plunger 30, thereby forming the downwardly sloping flanks $21^1$ referred to above. The outer edge of the plunger 30 rides on the vertical sidewalls of the aperture 20 formed by the lock plate 12, thereby holding the plunger 30 centered within the aperture 20**.

To lift the plunger 30 within the aperture 20 of the lock plate 12, pressurized air is applied to the underside of the plunger 30 via an air passage 33 formed in the platen 10. This air passage 33 is part of a manifold system which supplies pressurized air to plungers within each of the apertures from a pressurized air source 34 via a three-way valve 35 which is used to turn the air on and off. A gasket 36 at the lower end of the aperture 20 in the lock plate 12 prevents the leakage of air between the lock plate 12 and the top surface of the platen 10. To prevent the pressurized air from entering into the interface between the plunger 30 and the diaphragm 21, the top corner of the outer edge of the plunger 30 is pressed firmly against the underside of the diaphragm 21. An air vent 37 is also provided in the peripheral portion of the diaphragm 21 to exhaust any air from the interface between the plunger 30 and the diaphragm 21, thereby insuring against ballooning of the diaphragm when the plunger 30 is advanced. The air vent 37 communicates with an exhaust port 38 formed in the top surface of the lock plate 12.

As can be seen from the foregoing detailed description, this invention provides an improved mold locking device which can be economically installed during the fabrication of the platen assembly, and which prevents the leakage of sand into the interior of the locking device. This device virtually eliminates wear and maintenance problems due to sand leakage into the locking mechanism, and thereby provides a long maintenance-free operating life.

What is claimed is:

1. In a machine for making sand molds for foundries and including a flask defining side walls of a mold, a platen assembly at one open end of the flask and a squeeze head at the other open end of the flask for compacting sand in the flask when the platen assembly and squeeze head are advanced relatively toward each other, the improvement comprising a plurality of apertures in the top surface of the platen assembly, a resilient diaphragm extending across each aperture, and means for extending each diaphragm upwardly through the aperture associated therewith so that the extended diaphragm protrudes into sand within the flask and thereby locks a sand mold against movement parallel to the top of said platen assembly.

2. The machine of claim 1 wherein the edges of each diaphragm are sealed to said platen assembly to prevent the leakage of sand past the edges of each diaphragm.

3. The machine of claim 1 wherein said means for extending each diaphragm comprises a plunger mounted for movement between a retracted position in which the plunger allows the diaphragm to relax within the aperture associated therewith, and an advanced position in which the plunger presses the diaphragm upwardly through the associated aperture so that the diaphragm extends above the top surface of the platen assembly, and means for moving said plunger between said advanced and retracted positions.

4. The machine of claim 3 wherein said means for moving said plunger comprises a source of pressurized air, and a controllable manifold for connecting said source of pressurized air to each plunger.

5. The machine of claim 3 wherein each diaphragm and said platen assembly form an air vent for exhausting air from the interface between each plunger and each diaphragm to prevent ballooning of each diaphragm when each plunger is advanced.

6. The machine of claim 1 wherein said platen assembly comprises a platen and a lock plate and a wear plate fastened to the top of the platen, said apertures being formed in both the lock plate and the wear plate, and each diaphragm being captured between the lock plate and the wear plate.

7. The machine of claim 6 wherein each plunger is located within said aperture associated therewith in the lock plate and below each diaphragm, with each plunger being attached to the central portion of the associated diaphragm.

8. The machine of claim 7 wherein said platen forms air holes leading into each aperture in the lock plate for supplying pressurized air to the lower surfaces of each plunger for lifting the plunger.

* * * * *